United States Patent [19]

Bakoledis

[11] 3,978,759

[45] Sept. 7, 1976

[54] CONTRACTIBLE GUIDE FOR STUDS

[75] Inventor: Andrew G. Bakoledis, Clinton, Conn.

[73] Assignee: USM Corporation, Boston, Mass.

[22] Filed: Mar. 7, 1975

[21] Appl. No.: 556,299

[52] U.S. Cl. ..... 85/10 E; 227/9

[51] Int. Cl.[2] ..... B25D 17/00

[58] Field of Search ..... 85/10 E; 227/9, 10, 227/11, 139

[56] References Cited

UNITED STATES PATENTS

| | | | |
|---|---|---|---|
| 2,761,348 | 9/1956 | Williams et al. | 85/10 E |
| 3,129,429 | 4/1964 | Hilti | 227/10 |
| 3,289,522 | 12/1966 | Bell | 85/10 E |
| 3,494,018 | 2/1970 | Helderman et al. | 85/10 |

FOREIGN PATENTS OR APPLICATIONS

| | | | |
|---|---|---|---|
| 273,366 | 10/1965 | Australia | 85/10 E |
| 506,755 | 11/1951 | Belgium | 227/9 |
| 518,452 | 3/1953 | Belgium | 227/10 |
| 644,779 | 7/1962 | Canada | 227/9 |
| 1,117,318 | 2/1956 | France | 85/10 E |
| 1,050,127 | 2/1959 | Germany | 85/10 E |
| 966,781 | 8/1964 | United Kingdom | 85/10 E |

*Primary Examiner*—Roy D. Frazier
*Assistant Examiner*—Rodney H. Bonck

[57] ABSTRACT

A resilient, axially slotted sleeve in the form of a split collar is removably mounted on the trailing threaded end portion of a fastener to be driven into hard material such as steel or concrete. The sleeve preferably includes compressible peripheral projections for temporarily retaining the fastener when loaded in the muzzle of a driving tool. Having aided in guiding the fastener during driving and protected its threads from deformation and/or clogging, the sleeve is thereafter strippable conveniently by radial peeling movement from the driven fastener to enable a nut or other threaded element to be secured thereto.

2 Claims, 6 Drawing Figures

CONTRACTIBLE GUIDE FOR STUDS

BACKGROUND OF THE INVENTION

This invention relates to threaded fastener assemblies, and more particularly to the provision of an improved guide and protective retention means removably mountable on threaded portions of studs and the like.

It has become common in construction work to use powder actuated tools for driving fasteners such as studs into concrete and other hard material. Many of these tools, mainly for reasons of safety, incorporate a driving ram for striking each muzzle loaded fastener axially and causing its pointed nose portion to exit from the muzzle bore and penetrate directly into the hard material. A washer ring on the fastener may be used to limit the extent of such penetration. In any event, a trailing threaded portion of the anchored fastener desirably projects to some extent to receive a mating threaded member such as a nut. The washer ring, if used, may partly serve as a guide for the fastener leading end as its driven. It is important that the fastener threads remain in good working condition for facilitating a subsequent connection, that they be properly guided from a muzzle, and that the fastener be conveniently loadable in the muzzle and reliably retained therein until firing occurs. Axial removal of the protective guide from the driven fastener is usually difficult and may be avoided when using the guide herein disclosed.

SUMMARY OF THE INVENTION

In view of the foregoing it is a main object of this invention to provide, for use in combination with a threaded fastener such as a stud, a protective guide for the stud threads, which guide shall also be easily mountable thereon before fastener driving and conveniently demountable thereafter as by radial separation or peeling.

A further object of this invention is to provide, for use in a muzzle loading, powder actuated ram-driving tool, a combination radially separable guide and thread protector for a fastener to be driven and including a threaded portion, said guide-protector being adapted to frictionally retain the fastener in a muzzle bore of the tool.

To these ends and as herein shown a feature of the invention resides in the provision of an axially split or radially separable through slotted tubular, resilient guide radially contractible and expandable to fit over the threads of a stud and frictionally engage the wall of a muzzle bore from which the fastener is to be impelled. Preferably, and as herein shown, more than one external projection is formed on the guide so that, when it is assembled on the fastener and the latter is thrust into a muzzle bore of a powder actuated tool, the projections are radially compressible by interference fit and provide suitable frictional retention regardless of the direction in which the tool may thereafter be directed.

BRIEF DESCRIPTION OF THE DRAWINGS

The foregoing and other features of the invention will now be more particularly described in connection with an illustrative embodiment and with reference to the accompanying drawings thereof, in which.

DESCRIPTION OF PREFERRED EMBODIMENTS

Figure 1:
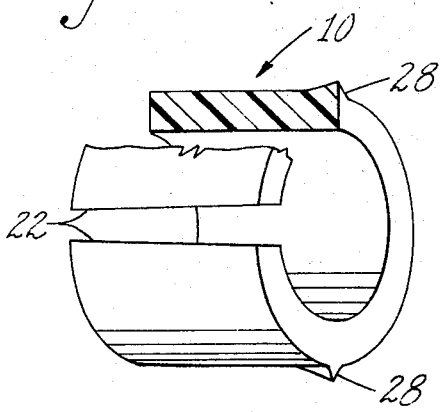
FIG. 1 is an enlarged perspective view, with a portion broken away, of a combination guide and thread protector.
Figure 2:
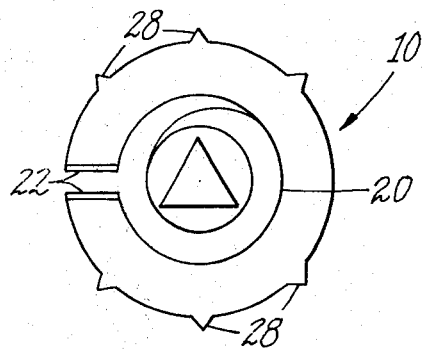
FIG. 2 is an end view of the guide of FIG. 1, but having additional peripheral projections, and mounted on a stud.
Figure 3:
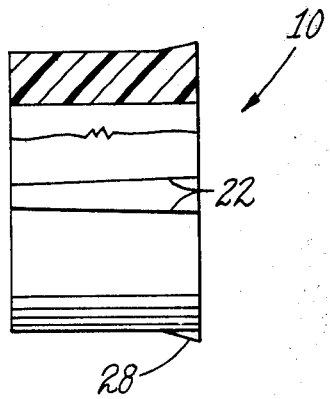
FIG. 3 is a view in side elevation of the guide shown in FIG. 1 with a portion broken away.
Figure 6:
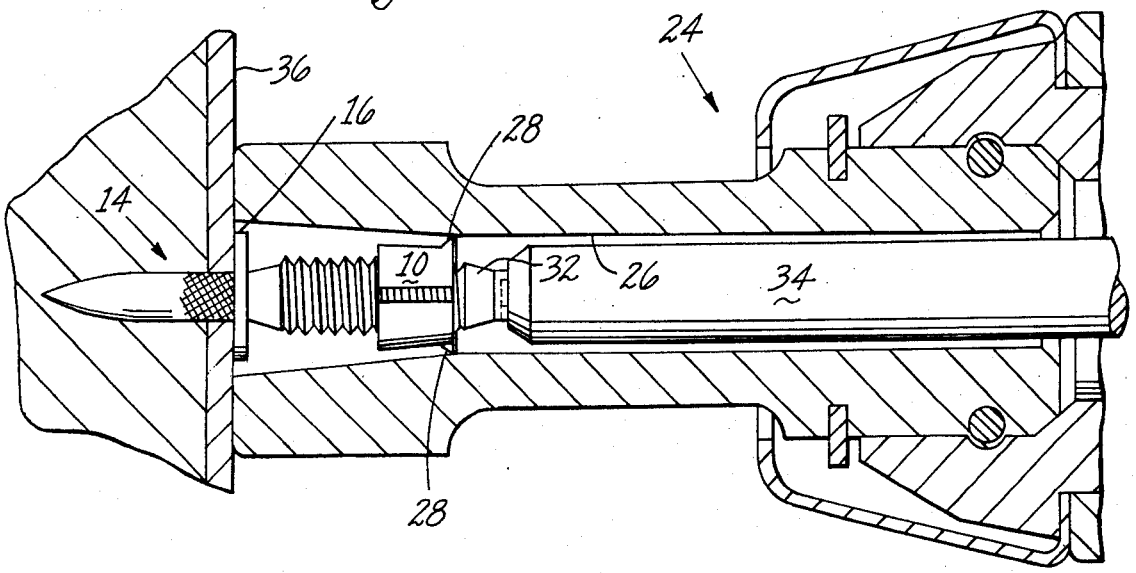
FIG. 6 is a view similar to FIG. 5 but showing the fastener assembly driven into a structure.

Although not necessarily limited for use with threaded studs, this invention primarily contemplates provision of a combination fastener guide and protective retention means 10 (FIG. 13) therefore. It will be appreciated that usage of the invention is not limited to stud assemblies 12 (FIG. 4) wherein the threaded member carries a penetration limiting washer 16 respectively, or to fasteners of any particular shape. As shown in FIGS. 1–3 the guide-protector 10 is of tubular shape and desirably of resilient material such as high density polyethylene, for instance. The length of the guide 10 is sufficient to at least partly cover and protect a threaded trailing end portion 20 formed on the stud. The guide is in the form of a split collar has an axial slit or slot 22 which preferably tapers axially from one extremity to the other to facilitate removal of the guide from its mold. The slot 22 permits the guide 10 to be radially expandable or contractible for purposes hereinafter to be explained, and also enables the guide to be easily mounted on the fastener prior to loading in a tool 24 and alternatively to be stripped as by radial separation from the fastener when it has been driven as illustrated in FIG. 6.

Figure 4:
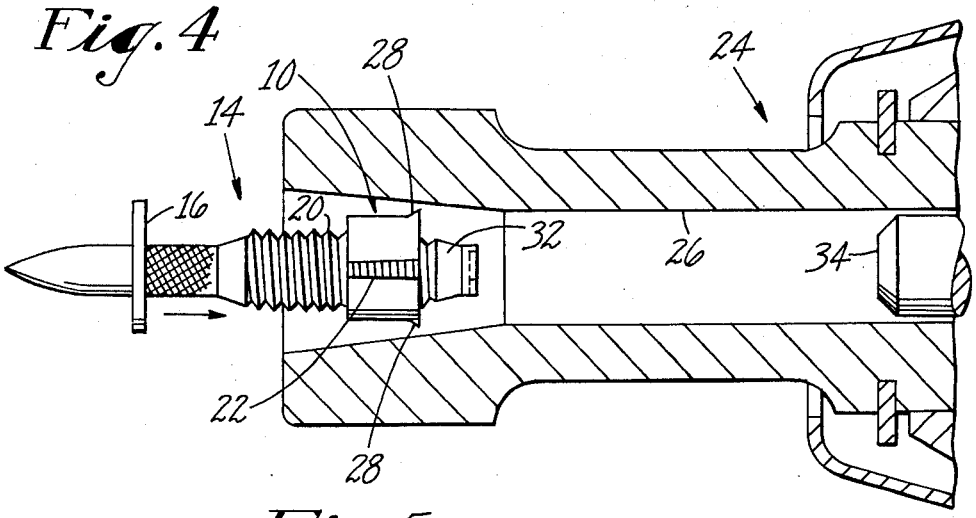
FIG. 4 is an axial section of a muzzle or adaptor portion of a powder actuated tool receiving a stud with the guide-protector.

For frictionally retaining the fastener assembly in an adaptor or muzzle bore 26 of the tool 24 the guide 10 desirably has more than one external, circularly spaced radial projection 28 (FIG. 2). As shown in FIGS. 1, 3, two are diametrically provided, and additional ones (shown in FIG. 2) may be optionally formed when it is desirable to increase frictional retention of the fastener assembly 12. In its non-confined condition the guide 10 has its diameter across opposed tips of projections 28 slightly greater than the inside diameter of the bore 26. The mouth of the latter preferably has a bevel to facilitate fastener assembly insertion, the projections 28 being slightly contractible radially as they are moved axially from their position as indicated in FIG. 4 to that shown in FIG. 5. Accordingly, very little resistance to loading is encountered, but elastic memory of the compressed guide material remaining when the slot 22 has been narrowed from its unrestricted width assures that the fastener assembly 12 has adequate frictional resistance to retain it in the bore 26 regardless of the direction in which the tool may be directed. It is generally, though not necessarily, preferred that the projections 28 be disposed at that end of the guide 10 having the wider portion of the slot 22.

Figure 5:
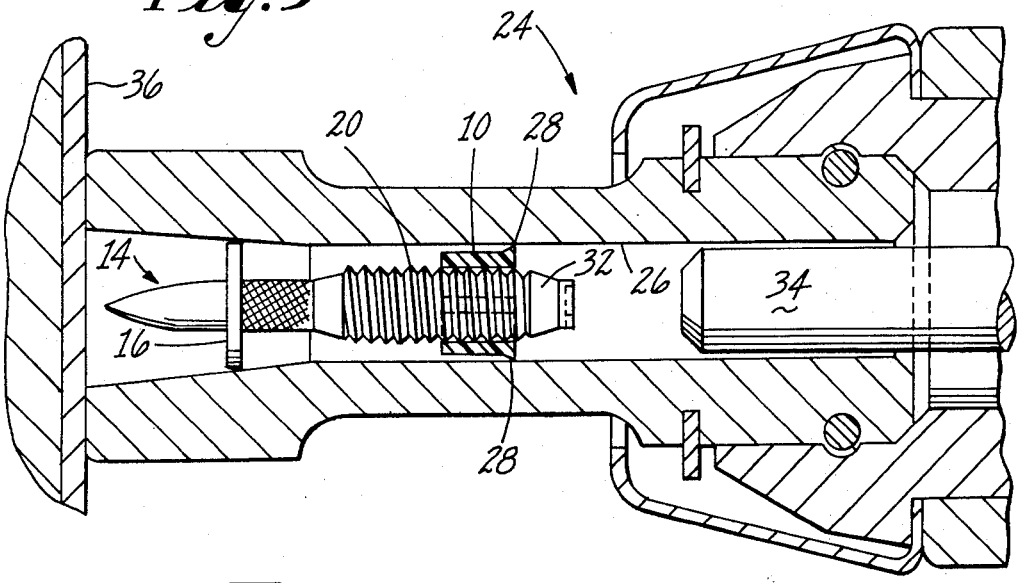
FIG. 5 is a view similar to FIG. 4 and showing the fastener assembly fully loaded and ready to be fired.

It will be appreciated from the foregoing that the guide-protector 10 is easily mounted on the stud portion 20 prior to loading the tool 24, the slot 22 permitting expansion so that the inside diameter of the guide lightly engages the thread peaks. A tapered stud end portion 32 (FIGS. 1 and 4–6) may have its larger diameter substantially equal to that of the stud threads to enable axial pushing on the guide. Whether washer 16 is provided, or no washer is employed, the inserted fastener assembly will be slidably retained by the projections 28 lightly compressed radially in the bore until the tool is fired. Than a ram 34 is caused to strike the inner end of the stud assembly to drive its pointed nose portion axially into hard receiving structure 36 (FIGS. 5 and 6). On withdrawal of the tool from the projecting threaded end portion of the anchored fastener assembly, or at any convenient subsequent time when a threaded member (not shown), such as a nut, is to be secured to the threaded projecting end of the stud, the combination guide-protector 10 may be easily stripped radially therefrom. Peeling off of the guide radially from the driven stud is effected conveniently for instance, by simply seizing an edge portion defining the slot 22 and pulling radially.

From the foregoing it will be appreciated that the novel assembly enables a threaded fastener to be reliably guided into operating position and the easily strippable guide.assures that threads of the driven fastener will then be in good condition to receive a member to be secured thereto.

Having thus described my invention what I claim as new and desire to secure as Letters Patent of the United States is:

1. A muzzle-loading fastener assembly of the type drivable by a powder actuated tool comprising a fastener having a threaded trailing end portion, and a tubular combination guide and protector of deformable material strippable from covering relation with said threaded portion by radial removal therefrom, said guide-protector being resilient and formed with only one axial slit extending the entire distance between its extremities, and having an axial edge portion to be seized for effecting the removal, and having a plurality of external projections extending outwardly from said threaded trailing end portion and adapted to frictionally retain the fastener for loading in a muzzle bore of said tool.

2. An assembly as in claim 1 wherein said slit is axially tapered and defined by said edge portion, the greater circumferential width of the slit at one extremity being sufficiently large to facilitate distortion and radial peeling off of the guide-protector from the fastener when driven.

* * * * *

UNITED STATES PATENT OFFICE

CERTIFICATE OF CORRECTION

Patent No. 3,978,759 Dated September 7, 1976

Inventor(s) Andrew G. Bakoledis

It is certified that error appears in the above-identified patent and that said Letters Patent are hereby corrected as shown below:

In Column 1, line 44, please delete "separable" and insert --strippable--;

In Column 3, line 1, in between "ting" and "expansion" please insert --radial--.

Signed and Sealed this

Fourteenth Day of December 1976

[SEAL]

*Attest:*

RUTH C. MASON
*Attesting Officer*

C. MARSHALL DANN
*Commissioner of Patents and Trademarks*